US009398642B2

(12) United States Patent
Swain et al.

(10) Patent No.: US 9,398,642 B2
(45) Date of Patent: Jul. 19, 2016

(54) REMOVABLE HEATER FOR COMMUNICATION ANTENNA

(71) Applicants: Richard Lawrence Swain, Ottawa (CA); Jeffrey Allan Thomson, Brockville (CA)

(72) Inventors: Richard Lawrence Swain, Ottawa (CA); Jeffrey Allan Thomson, Brockville (CA)

(73) Assignee: Thales Canada Inc, Toronto, Ontario (CA)

( * ) Notice: Subject to any disclaimer, the term of this patent is extended or adjusted under 35 U.S.C. 154(b) by 639 days.

(21) Appl. No.: 13/657,545

(22) Filed: Oct. 22, 2012

(65) Prior Publication Data

US 2014/0110400 A1 Apr. 24, 2014

(51) Int. Cl.

| | |
|---|---|
| ***H05B 3/06*** | (2006.01) |
| ***H05B 3/10*** | (2006.01) |
| ***H05B 3/34*** | (2006.01) |

(52) U.S. Cl.

CPC ..... *H05B 3/34* (2013.01); *H05B 2203/013* (2013.01)

(58) Field of Classification Search

CPC ..... H05B 2203/013; H05B 3/28–3/286; H01Q 1/02

USPC ..... 219/544–549, 552

See application file for complete search history.

(56) References Cited

U.S. PATENT DOCUMENTS

| | | | | | |
|---|---|---|---|---|---|
| 4,716,396 | A | * | 12/1987 | Kneifel | 338/226 |
| 4,844,526 | A | | 7/1989 | Young | |
| 4,866,452 | A | | 9/1989 | Barma et al. | |
| 5,617,107 | A | * | 4/1997 | Fleming | 343/704 |
| 5,688,331 | A | * | 11/1997 | Aruga et al. | 118/725 |
| 5,796,368 | A | * | 8/1998 | Arthur, III | 343/704 |
| 5,942,140 | A | | 8/1999 | Miller et al. | |
| 6,137,446 | A | | 10/2000 | Jones | |
| 6,175,335 | B1 | | 1/2001 | Ishikawa et al. | |
| 6,195,056 | B1 | | 2/2001 | Jones | |
| 6,445,349 | B1 | | 9/2002 | Jones | |
| 7,173,219 | B2 | * | 2/2007 | Okajima et al. | 219/444.1 |
| 7,776,833 | B2 | | 8/2010 | Zhilov | |
| 8,822,887 | B2 | * | 9/2014 | Koonce | 219/480 |

(Continued)

FOREIGN PATENT DOCUMENTS

| | | | |
|---|---|---|---|
| EP | 0268362 | A1 | 5/1988 |
| JP | 946111 | C | 3/1979 |
| JP | 1127018 | A | 5/1989 |
| JP | 5327327 | A | 12/1993 |
| JP | 10261908 | A | 9/1998 |

(Continued)

OTHER PUBLICATIONS

International Search Report for corresponding International PCT Application No. PCT/IB2013/002366 dated Jun. 9, 2014.

*Primary Examiner* — Sang Y Paik

(74) *Attorney, Agent, or Firm* — Hauptman Ham, LLP

(57) ABSTRACT

A heater assembly including a foil heater having at least one slot. The heater assembly includes an insulating plate configured to electrically and thermally insulate the foil heater, the insulating plate having a central opening, at least one first mounting hole and at least one first fastening hole. The heater assembly includes a heat dissipation element configured to conduct heat from the foil heater to an exterior of the heater assembly, the heat dissipation element having at least one second mounting hole and at least one second fastening hole. The foil heater is between the insulating plate and the heat dissipation element. The at least one first mounting hole, the at least one slot and the at least one second mounting hole are aligned. The at least one first fastening hole, the at least one slot and the at least one second fastening hole are aligned.

20 Claims, 9 Drawing Sheets

(56) References Cited

U.S. PATENT DOCUMENTS

| | | | | |
|---|---|---|---|---|
| 8,872,710 | B2 * | 10/2014 | Wallace | 343/704 |
| 2011/0298675 | A1 | 12/2011 | Cummings | |
| 2012/0090784 | A1 | 4/2012 | Ouye et al. | |

FOREIGN PATENT DOCUMENTS

| | | | |
|---|---|---|---|
| JP | 2007110362 | A | 4/2007 |
| KR | 20110027621 | | 3/2011 |
| WO | 2012054238 | | 4/2012 |

* cited by examiner

REMOVABLE HEATER FOR COMMUNICATION ANTENNA

BACKGROUND

Consistent and reliable communication is an important aspect with respect to an ability to coordinate efforts between multiple actors. In environments where wired communication is unavailable, wireless instruments, such as antenna, are used to maintain communication.

Some environments, which experience extreme weather conditions such as extremely low temperatures, can hamper an ability of an antenna to send and receive information. In some instances, when electronic components of an antenna or other electronic devices drop below a certain temperature the antenna will stop functioning or function improperly.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
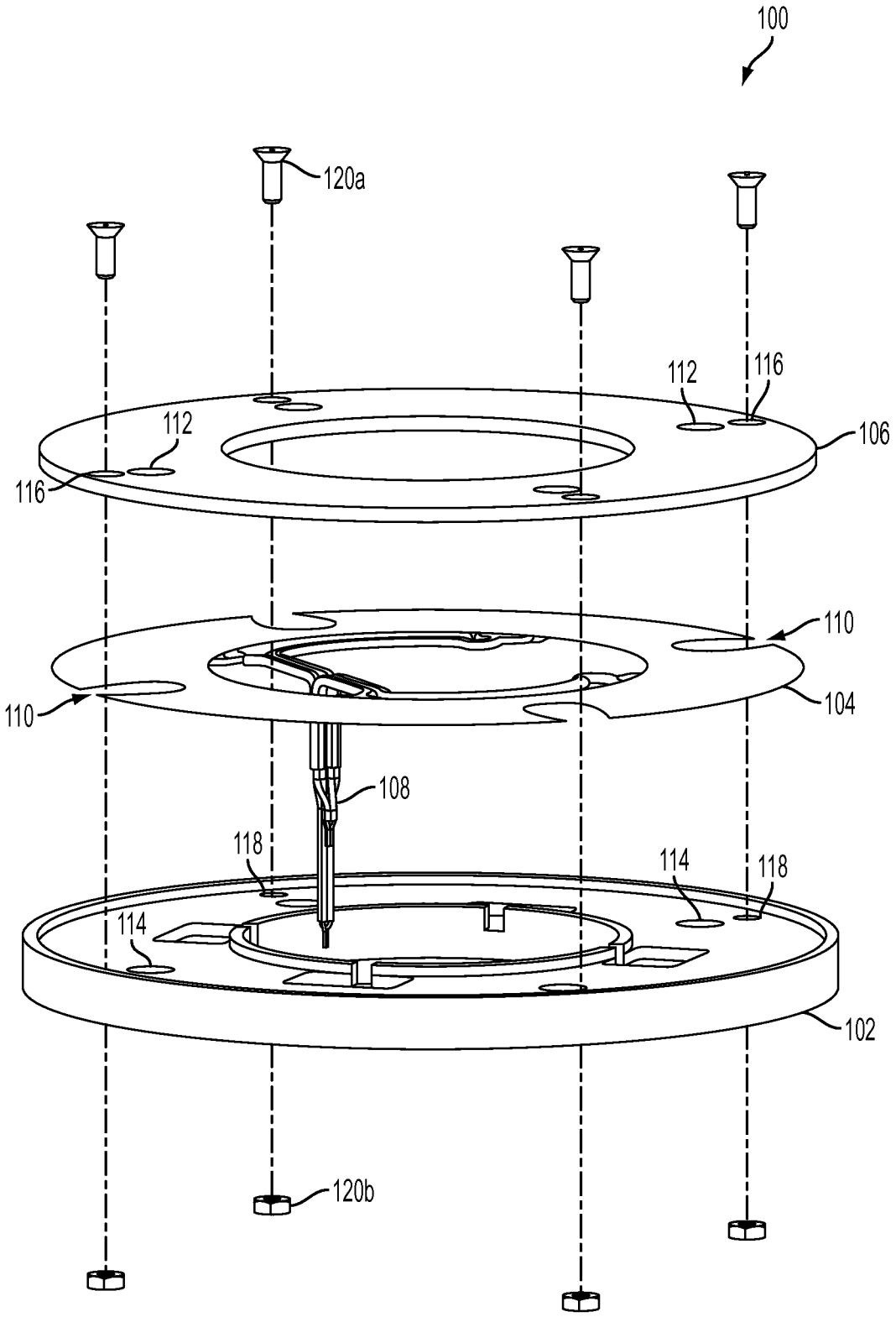
FIG. 1 is an exploded view of a heater assembly, in accordance with one or more embodiments.

FIG. 1 is an exploded view of a heater assembly 100. Heater assembly 100 includes an insulating plate 102, a foil heater 104 and a heat dissipation element 106, where the foil heater is positioned between the insulating plate and the heat dissipation element. Heater assembly 100 is configured to use an electrical resistance of foil heater 104 to generate heat which is then conveyed to external devices through heat dissipation element 106. Insulating plate 102 is configured to electrically and thermally insulate heater assembly 100 on three sides.

In some embodiments, heater assembly has a flattened ring shape having a concentric central opening. Each of the insulating plate 102, foil heater 104 and heat dissipation element 106 have the ring shape having the concentric central opening. The insulating plate 102 is securely fastened to heat dissipation element 106 by fastening means. Foil heater 104 is held against insulating plate 102 by a downward force exerted by heat dissipation element 106 because of the fastening means securing the heat dissipation element to the insulating plate. Foil heater 104 is configured to generate heat using electrical resistance. A top surface of heat dissipation element 106 is configured to contact a device to be heated, such as an antenna, to transfer the heat generated by foil heater 104 via conductive heat transfer. Insulating plate 102 is configured to thermally insulate foil heater 104 on three sides to prevent the heat generated by foil heater 104 from escaping heater assembly 100 by any means other than heat dissipation element 106.

Foil heater 104 includes wires 108 to provide electrical power to the foil heater. Foil heater 104 also includes at least one slot 110 formed as a recess in an outer circumference of the foil heater. Slot 110 is configured to allow both a fastening and a mounting element to pass through the foil heater without interfering with the functioning of the foil heater. In some embodiments, foil heater 104 includes a plurality of slots 110. In some embodiments, the plurality of slots 110 is evenly distributed around a circumference of foil heater 104. In some embodiments, slot 110 is replaced by a single hole in foil heater 104. The single hole is sufficiently large to allow both the fastening and the mounting element to pass through foil heater 104 without interfering with the functioning of the heater. In some embodiments, slot 110 is replaced by a plurality of holes in foil heater 104. One of the plurality of holes is configured to allow the fastening element to pass through foil heater 104. Another of the plurality of holes is configured to allow the mounting element to pass through foil heater 104.

Heat dissipation element 106 includes at least one mounting hole 112 for receiving the mounting element. Insulating plate 102 includes at least one mounting hole 114 for receiving the mounting element. In some embodiments, heat dissipation element 106 includes a plurality of mounting holes 112 and insulating plate 102 includes a plurality of mounting holes 114. In some embodiments, the plurality of mounting holes 112 and the plurality of mounting holes 114 are evenly distributed around a circumference of heat dissipation element 106 and insulating plate 102, respectively. A number of mounting holes 112 is the same as a number of mounting holes 114. Mounting holes 112, slots 110 and mounting holes 114 are aligned to facilitate mounting of heater assembly 100 to an antenna via the mounting elements. In some embodiments, the mounting elements comprise nuts and bolts. In some embodiments, the mounting elements include screws, pins or other suitable elements.

Heat dissipation element 106 further includes at least one fastening hole 116 for receiving the fastening element. Insulating plate 102 also includes at least one fastening hole 118 for receiving the fastening element. In some embodiments, heat dissipation element 106 includes a plurality of fastening holes 116 and insulating plate 102 includes a plurality of fastening holes 118. In some embodiments, the plurality of fastening holes 116 and the plurality of fastening holes 118 are evenly distributed around a circumference of heat dissipation element 106 and insulating plate 102, respectively. A number of fastening holes 116 is the same as a number of fastening holes 118. Fastening holes 116, slots 110 and fastening holes 118 are aligned to facilitate fastening of heat dissipation element 106 to insulating plate 102 with foil heater 104 positioned in between. In some embodiments, the fastening elements comprise nuts 120*a* and bolts 120*b*. In some embodiments, the fastening elements are screws, pins or other suitable elements. In some embodiments, the fastening elements comprise snap-fit elements, detents, adhesives or other suitable elements which do not pass through heater assembly 100. In some embodiments where the fastening elements do not pass through heater assembly 100, fastening holes 116 and 118 are omitted.

In some embodiments, the mounting means and the fastening means are replaced by a securing means which fasten heater dissipation element 106 to insulating plate 102 as well as mount heater assembly 100 to the antenna. In some embodiments, the securing means comprises a plurality of securing means. In some embodiments having the securing means, fastening holes 116 and 118 are omitted from heat dissipation element 106 and insulating plate 102, respectively.

Figure 2:
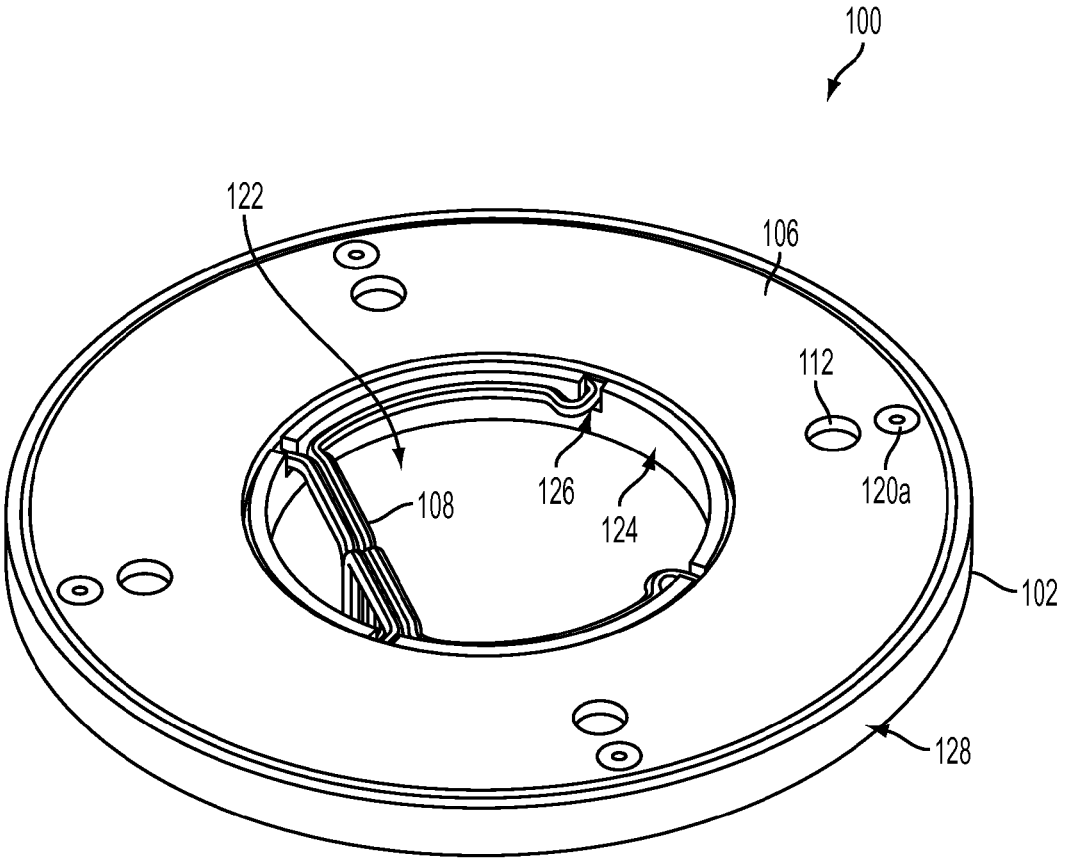
FIG. 2 is a top perspective view of the heater assembly, in accordance with one or more embodiments.

FIG. 2 is a top perspective view of assembled heater assembly 100. In FIG. 2, heat dissipation element 106 is securely fastened to insulating plate 102 via bolts 120*a*. Foil heater 104 is positioned between heat dissipation element 106 and insulating plate 102 and is not visible in FIG. 2. If heat dissipation plate 106 is securely fastened to insulating plate 102, as depicted in FIG. 2, heater assembly 100 is insulated from exterior weather conditions, such as precipitation. In some embodiments, heater assembly 100 is insulated from exterior weather conditions if the heater assembly is mounted to the antenna. In some embodiments where heater assembly 100 is mounted on a ship, the heater assembly is insulated from water spray from a body of water surrounding the ship. Insulating plate 102 and heat dissipation element 106 form a sealed interior environment to protect foil heater 104 and prevent short circuits from damaging heater assembly 100. In some embodiments, a silicone sealant is injected around edges of heat dissipation element 106 to form the sealed interior environment. In some embodiments, an o-ring or other suitable sealing element is used to form the sealed interior environment.

Heater assembly 100 includes a central opening 122 which is defined by an inner wall 124 of insulating plate 102. Central opening 122 is configured to facilitate mounting of heater assembly 100 to an antenna having a support, such as a pole or a mast. Wires 108 extend from foil heater 104 through inner wall 124 and central opening 122 to connect to a power source configured to supply power to foil heater 104, in some embodiments. In some embodiments, insulating plate 102 includes inner wall 124 configured to protect foil heater 104 from exterior conditions. Inner wall 124 includes at least one hole 126 to allow wires 108 to pass from the interior of heater assembly 100 to the exterior of the heater assembly. In some embodiments, insulating plate 102 includes openings in a bottom surface of the insulating plate to allow wires 108 to electrically connect foil heater 104 to the power source. Insulating plate 102 also includes an outer wall 128 configured to protect foil heater 104 from exterior conditions.

Figure 3:
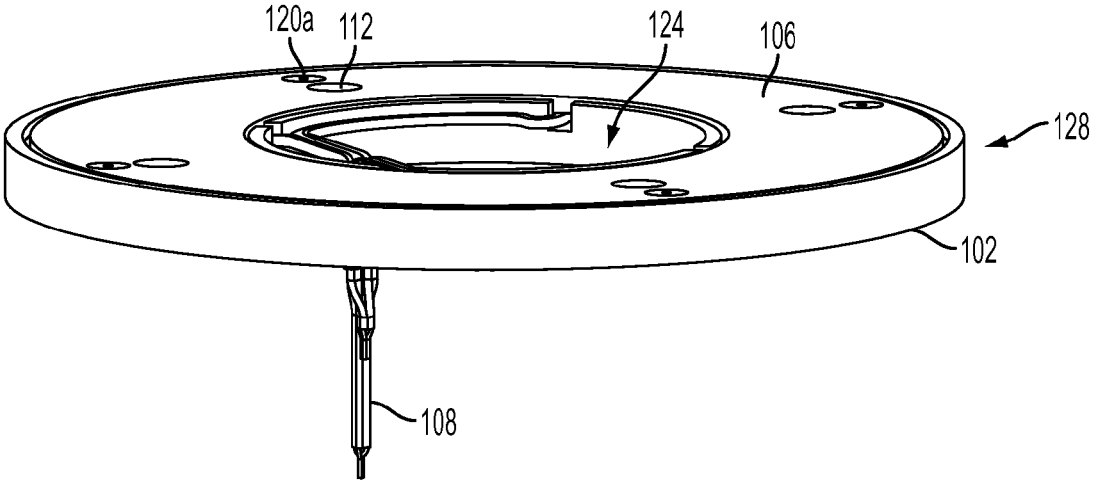
FIG. 3 is a side perspective view of the heater assembly, in accordance with one or more embodiments.

FIG. 3 is a side perspective view of heater assembly 100. Wires 108 extending beyond a bottom surface of insulating plate 102. Heat dissipation element 106 extends above an upper edge of inner wall 124 and outer wall 128. By extending above the upper edge of inner wall 124 and outer wall 128, heat dissipation plate 106 is capable of transferring heat generated by foil heater 104 to recessed surfaces of an antenna via conduction without relying on convective heat transfer. In some instances, such as high winds, convective heat transfer is incapable of providing adequate thermal energy to the antenna thereby reducing the ability to prevent malfunction of the antenna. In some embodiments, heat dissipation element 106 is substantially level with the upper edge of inner wall 124 and outer surface 128. By protecting more of heat dissipation element 106 with inner wall 124 and outer wall 128, corrosion of the heat dissipation element is reduced. Also, heat lost from sidewalls of heat dissipation element 106 is reduced because inner wall 124 and outer wall 128 of insulating plate 102 provide thermal insulation for the heat dissipation element.

Figure 4:
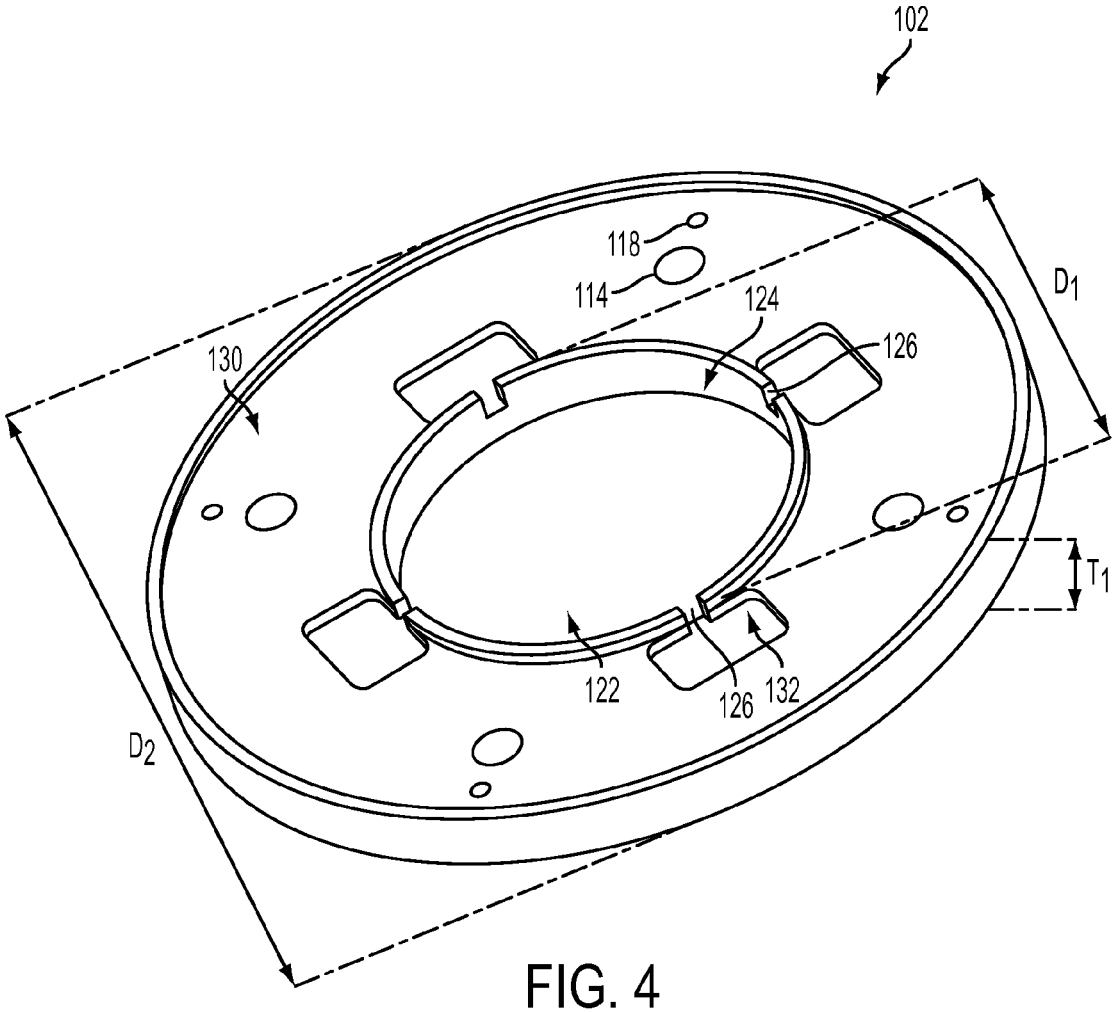
FIG. 4 is a perspective view of an insulating plate, in accordance with one or more embodiments.

FIG. 4 is a perspective view of insulating plate 102. Insulating plate 102 includes a ring-shaped base portion 130 to support foil heater 104 and heat dissipation element 106. Insulating plate 102 also includes inner wall 124 and outer wall 128 which extend in a direction perpendicular to a surface of base portion 130. Base portion 130, inner wall 124 and outer wall 128 collectively form an enclosure on three sides to receive foil heater 104. Base portion 130 includes recesses 132. Recesses 132 are located adjacent to openings 126 to provide sufficient space for connection between wires 108 and a main body of foil heater 104. In some embodiments, base portion 130 does not include recesses 132.

Insulating plate 102 also includes mounting holes 114 and fastening holes 118. Mounting holes 114 are sufficiently wide to enable the mounting elements to pass through base portion 130. In some embodiments, heater assembly 100 is removably mounted to the antenna using nuts threaded onto the mounting elements and pressed against a backside of insulating plate 102. In some embodiments, fastening holes 118 extend completely through base portion 130 and heat dissipation element 106 is securely fastened to insulating plate 102 by nuts threaded onto the fastening elements to exert a force against the backside of the insulating plate. In some embodiments, fastening holes 118 do not extend completely through base portion 130. In some embodiments, fastening holes 118 are threaded and heat dissipation element 106 is securely fastened to insulating plate 102 using screws or bolts engaging the threads of fastening holes 118.

Insulating plate 102 has an inner diameter D1 defined by inner wall 124. Inner diameter D1 is sufficiently wide to enable heater assembly 100 to be mounted over a support, such as a pole or a mast. In some embodiments, inner diameter D1 ranges from 3 inches to 4 inches. In some embodiments, inner diameter D1 ranges from 3.075 inches to 4.175 inches.

Insulating plate 102 has an outer diameter D2 defined by outer wall 128. Outer diameter is sufficiently wide to enclose foil heater 104, where the foil heater has adequate surface area to provide enough heat to an antenna to maintain the antenna at an operative temperature. In some embodiments, outer diameter D2 ranges from 6.5 inches to 9.5 inches. In some embodiments, outer diameter D2 ranges from 6.695 inches to 9.055 inches.

Insulating plate 102 includes a thickness T1 defined by a height of outer wall 128. Thickness T1 provides protection for foil heater 104 to electrically and thermally insulate the foil heater from the exterior of heater assembly 100. Thickness T1 provides sufficient mechanical strength and rigidity to mount heater assembly 100 to the antenna and to withstand harsh environmental conditions. In some embodiments, thickness T1 ranges from 0.4 inches to 0.6 inches. In some embodiments, thickness T1 ranges from 0.425 inches to 0.575 inches.

The material of insulating plate 102 electrically and thermally insulates heater assembly 100 from the exterior environment. Thermal insulation minimizes a loss of heat generated by foil heater 104 in unintended directions and increases the efficiency of heater assembly 100. Electrical insulation helps to reduce the risk of short circuits and damage to heater assembly 100. In some embodiments, insulating plate 102 comprises high molecular weight polyethylene. In some embodiments, the high molecular weight polyethylene has a weight average molecular weight ranging from 20,000 grams per mol (g/mol) to 55,000 g/mol. In some embodiments, insulating plate 102 comprises polyether ether ketone (PEEK), polyphenylene sulfide (PPS) or other suitable thermally and electrically insulating materials having a sufficiently high operating temperature to withstand the heat generated by heater assembly 100.

Figure 5:
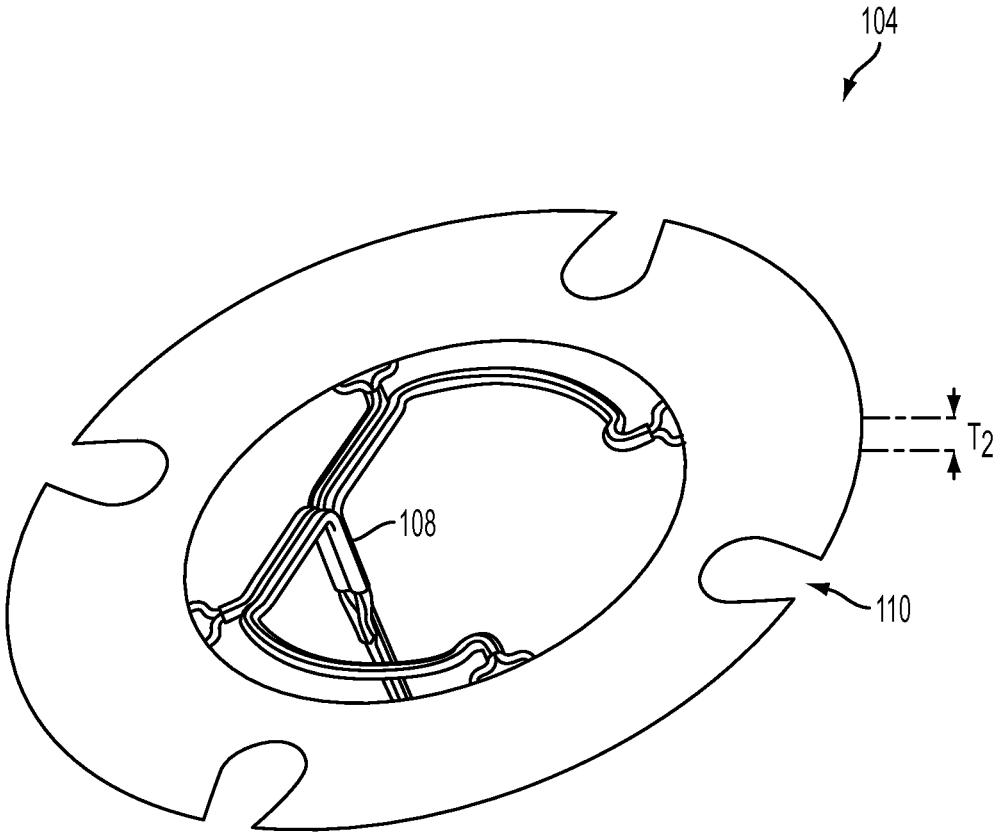
FIG. 5 is a perspective view of a foil heater, in accordance with one or more embodiments.

FIG. 5 is a perspective view of foil heater 104. Foil heater 104 is configured to generate heat using electrical resistance. Wires 108 are electrically connected to foil heater 104 to provide electrical power to the foil heater. Foil heater 104 includes slots 110 configured to allow both a fastening element and a mounting element to pass through the foil heater 104 without impeding the functionality of the foil heater.

Foil heater includes a plurality of conductive foils spaced between layers of electrically insulating material. As electricity supplied via wires 108 passes through the conductive foil, the electrical resistance of the conductive foil transforms a portion of the electrical energy to thermal energy. The electrically insulating material electrically isolates the conductive foils from one another to prevent short circuits within foil heater 104. At least one electrically insulating material is positioned on a top surface of foil heater 104 to electrically insulate heat dissipation element 106 from the foil heater. In some embodiments, the conductive foil comprises copper. In some embodiments, the conductive foil comprises aluminum, conductive polymer or other suitable conductive materials. In some embodiments, the electrically insulating material comprises polyimide. In some embodiments, the electrically insulating material comprises polyester, silicone rubber or other suitable insulating materials.

Foil heater 104 has a thickness T2. Thickness T2 determines the number of conductive foils which foil heater 104 is capable of containing. In some embodiments, thickness T2 ranges from 0.008 inches to 0.012 inches. In some embodiments, thickness T2 ranges from 0.0085 inches to 0.0115 inches.

In some embodiments, foil heater 104 includes more than one foil heater. In some embodiments, the foil heaters are capable of being activated independently of one another.

Figure 6:
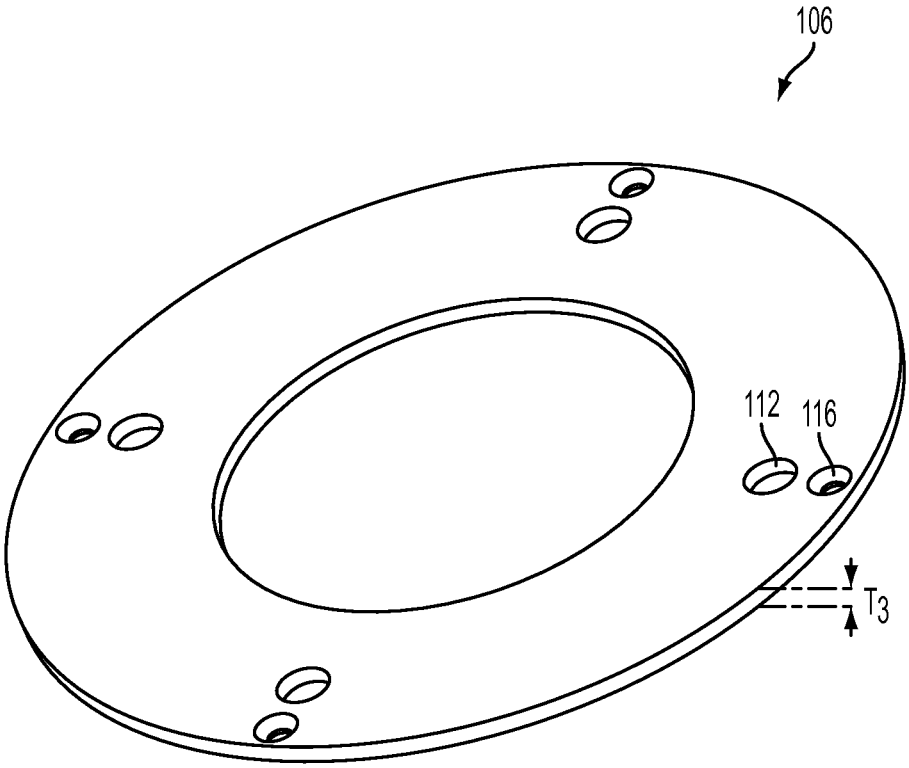
FIG. 6 is a perspective view of a heat dissipation element, in accordance with one or more embodiments.

FIG. 6 is a perspective view of heat dissipation element 106. Heat dissipation element 106 is configured to transfer heat generated by foil heater 104 to the exterior of heater assembly 100. Heat dissipation element 106 includes mounting holes 112 and fastening holes 116. Mounting holes 112 and fastening holes 116 pass completely through heat dissipation element 106. Mounting holes 112 are sufficiently wide to allow the mounting elements to pass through heat dissipation element 106. Fastening holes 116 are sufficiently wide to allow the fastening elements to pass through heat dissipation element 106. In some embodiments, fastening holes 116 are beveled so that a top portion of the fastening means is coplanar or recessed with respect to a top surface of heat dissipation element 106.

Heat dissipation element 106 has a thickness T3. Thickness T3 provides sufficient mechanical strength to avoid damage to heater assembly 100 during mounting of the heater assembly to an antenna. Thickness T3 is sufficiently thin to efficiently conduct heat generated by foil heater 104 to the antenna. In some embodiments, thickness T3 ranges from 0.1 inches to 0.15 inches. In some embodiments, thickness T3 ranges from 0.106 inches to 0.144 inches.

Heat dissipation element 106 comprises a thermally conductive material. As a coefficient of thermal conductivity of heat dissipation element 106 increases, the efficiency of heat transfer between foil heater 104 and the antenna increases. The material for heat dissipation element 106 is also corrosion resistant to minimize an amount of oxidation of the heat dissipation element. Oxidation reduces the efficiency of heat transfer. Severe instances of corrosion allow precipitation or water spray to enter heater assembly 100 and damage foil heater 104. In embodiments where heater assembly 100 is mounted on a ship, salt water spray increases a risk of corrosion. In some embodiments, heat dissipation element 106 comprises aluminum. In some embodiments, heat dissipation element 106 comprises copper, beryllium copper or other suitable thermally conductive material.

Figure 7:
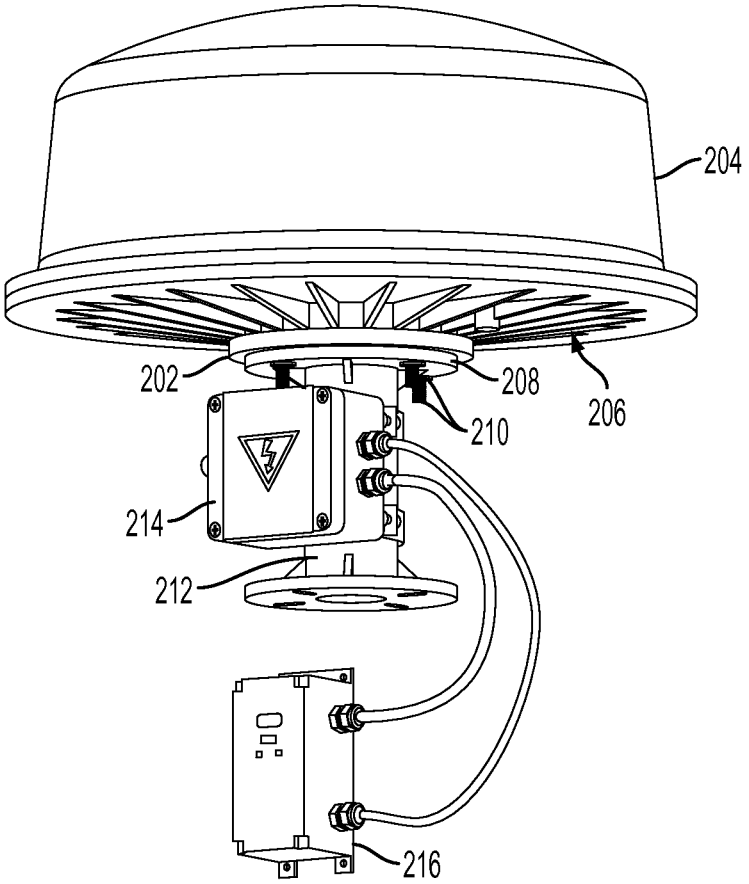
FIG. 7 is a perspective view of an antenna assembly having a removable heater assembly, in accordance with one or more embodiments.

FIG. 7 is a perspective view of a heater assembly 202 removably mounted to an antenna 204. Antenna 204 includes radiating fins 206. Heater assembly 202 is mounted to be in physical contact with radiating fins 206. In some embodiments, antenna 204 does not include radiating fins. In some embodiments, heater assembly 202 contacts antenna 204 at a location other than radiating fins 206. In some embodiments, heater assembly 202 covers substantially all of one surface of antenna 204. In some embodiments, heater assembly covers only a portion of one surface of antenna 204. A mounting base 308 is positioned on an opposite side of heater assembly 202 from antenna 204. Mounting elements 210 pass through heater assembly 202 and mounting base 208 for mounting antenna 204 and the heater assembly and the mounting base. A support post 212 is configured to support antenna 204 at an elevated position. A junction box 214 is configured to connect a power supply to heater assembly 202 and antenna 204. A controller 216 is configured to control junction box 214 to regulate the power supplied to heater assembly 202. In some embodiments, controller 216 also controls junction box 214 to regulate the power supplied to antenna 204.

Heater assembly 202 is the same as heater assembly 100. Heater assembly 202 is arranged so that heat dissipation element 106 is in physical contact with a bottom surface of antenna 204 to transfer heat to the antenna via conductive heat transfer. Insulating plate 102 is positioned adjacent mounting base 208. Mounting elements 210 pass through mounting holes 112, slots 110 and mounting holes 114 and through mounting base 208 to securely attach heater assembly 202 to antenna 204. Support post 212 passes through central opening 122. Wires 108 are electrically connected to junction box 214.

Antenna 204 is configured to send and receive wireless communications. Antenna 204 includes electronics powered by the power source connected at junction box 214. The electronics have an operating temperature range within which the electronics of antenna 204 operate properly. When the temperature of the electronics is outside the operating temperature range, the electronics may malfunction and potentially permanently damage antenna 204. In some embodiments, antenna 204 is an omni-directional antenna. In some embodiments, antenna 204 is configured to send and receive communications in a radio wave band. In some embodiments, antenna 204 is configured to send and receive communications in a micro-wave band or other suitable communication wave bands.

Radiating fins 206 are configured to provide a cooling or heat dissipation mechanism for antenna 204. The electronics of antenna 204 generate heat due to electrical resistance within the electronics. Operating antenna 204 when an exterior temperature is high potentially causes the electronics to generate sufficient heat to exceed an upper limit of the operating temperature range. Radiating fins 206 are configured to transfer the heat generated by the electronics to the exterior environment of antenna 204 to maintain the electronics with the operating temperature range. During operation of antenna 204 when the exterior temperature is low, the electronics may be at a temperature below a lower limit of the operating temperature range. Heater assembly 202 is configured to provide heat to the electronics via the bottom surface of antenna 204 in order for the electronics to be within the operating temperature range.

Mounting base 208 secures heater assembly 202 and antenna 204 to support post 212. Mounting base 208 has sufficient mechanical strength to resist damage resulting from environmental conditions acting on antenna 204, such as high velocity winds buffeting the antenna. Mounting base 208 includes holes configured to allow mounting element 210 to pass through the mounting base. Heater assembly 202 and antenna 204 are securely mounted on mounting base 208 by nuts secured against a back surface of the mounting base. In some embodiments, mounting base 208 is integral with support post 212. In some embodiments, mounting base 208 is removably attached to support post 212.

Mounting elements 210 include threaded fasteners such as nuts and bolts. In some embodiments, the bolts are integral with antenna 204 and protrude from a bottom surface of the antenna. In some embodiments, the bolts are screwed into threaded holes in the bottom surface of antenna 204. The bolts pass through heater assembly 202 and mounting base 208 and are secured using the nuts against the back surface of the mounting base. In some embodiments, mounting elements 210 are bolts which pass through mounting base 208, heater assembly 202 and into threaded holes in the bottom surface of antenna 204. In some embodiments, mounting elements 210 are screws, pins or other suitable mounting elements.

In some embodiments, a temperature sensor is connected to controller 216. The temperature sensor is connected to controller 216 and is configured to measure a temperature of the electronics of antenna 204. The temperature sensor is located in an environment which is thermally similar to the electronics of antenna 204 to provide an accurate measurement of the temperature of the electronics. In some embodiments, the temperature sensor is a thermocouple, a thermistor or other suitable temperature sensing element. In some embodiments, at least one of mounting elements 210 is hollow and includes a temperature sensor.

Figure 8B:
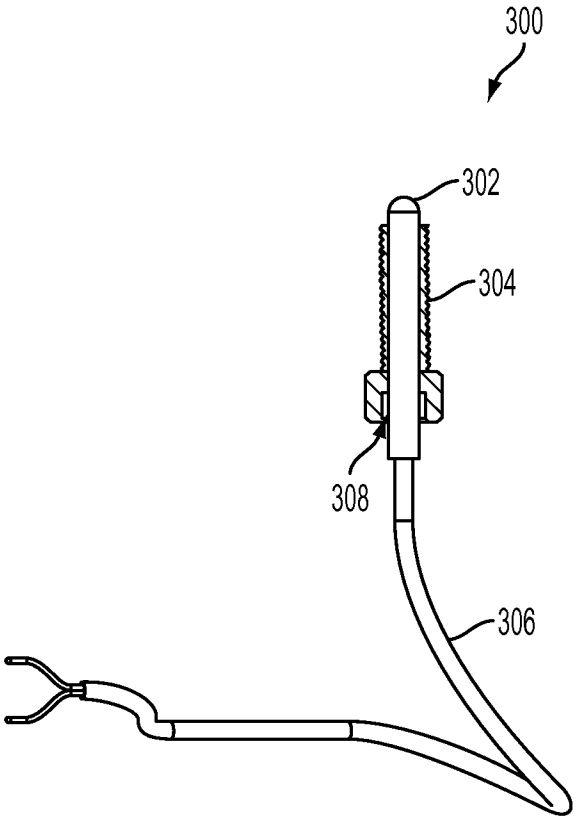
FIG. 8B is a cross-sectional view of the hollow mounting element having the temperature sensor therein, in accordance with one or more embodiments.
Figure 8A:
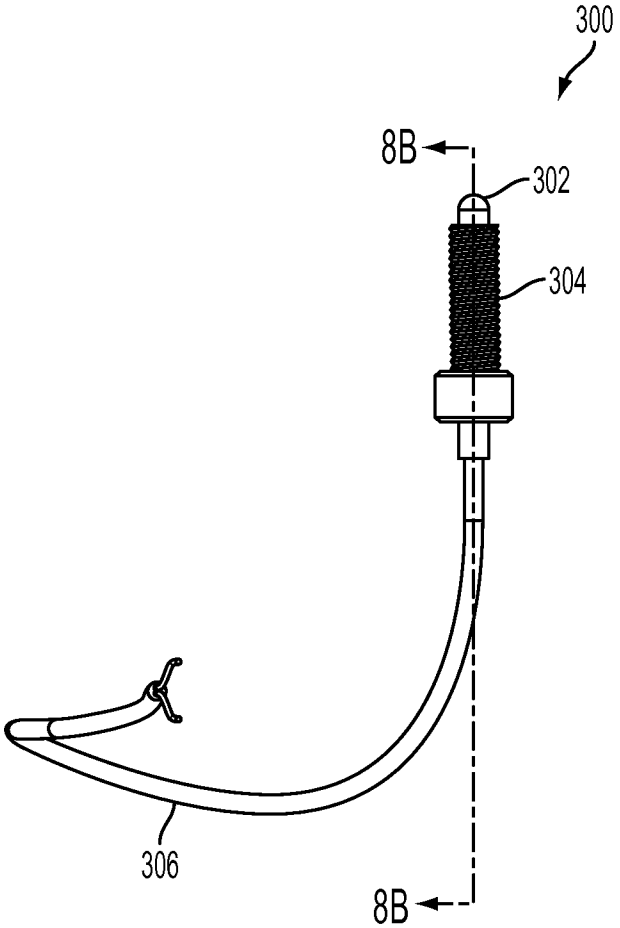
FIG. 8A is a side view of a hollow mounting element having a temperature sensor therein, in accordance with one or more embodiments.

FIG. 8A is a side view of a temperature sensor 300. Temperature sensor 300 includes a sensing element 302 passing through a hollow mounting element 304. Sensing element 302 is electrically coupled to a connector 306. Connector 306 is configured to transfer a measured temperature from sensing element 302 to controller 216. Hollow mounting element 304 has a same external structure as mounting elements 210. In some embodiments, hollow mounting element 304 has a different external structure than mounting elements 210. By inserting sensing element 302 through hollow mounting element 304 and into an interior of antenna 204, the temperature sensor is able to accurate measure a temperature of the electronics of the antenna.

FIG. 8B is a cross-sectional view of temperature sensor 300. Sensing element 302 passing through hollow mounting element 304. Hollow mounting element 304 includes an inner cavity 308 passes through the hollow mounting element. Sensing element 302 passes through inner cavity 308. Sensing element 302 is electrically connected to controller 216 to provide a signal based on a measured temperature of the electronics of antenna 204. In some embodiments, the temperature sensor is housed in antenna 204 or in another suitable location to measure a temperature of the electronics in the antenna.

Support post 212 is configured to support heater assembly 202 and antenna 204 at an elevated position to enhance communication abilities of the antenna. Support post 212 has sufficient mechanical strength to resist damage resulting from environmental conditions such as high winds. In some embodiments, support post 212 is a pole attached to a ship. In some embodiments, support post 212 is a pole attached to another type of vehicle. In some embodiments, support post 212 is a stationary stand-alone post. Support post 212 comprises metal, polymer or other suitable material.

Junction box 214 is configured to connect the power supply to heater assembly 202 and antenna 204. Junction box 214 is controlled by controller 216 and supplies power to heater assembly 202 based on signals received from the controller. In some embodiments, junction box 214 also connects the power supply to antenna 204 based on signals from controller 216. Junction box 214 is configured to transfer sufficient power to heater assembly 202 to enable the heater assembly to raise a temperature of antenna 204 to a temperature within the operating temperature range. In some embodiments, junction box 214 is configured to transfer approximately 500 watts (W) of power to heater assembly 202. Junction box 214 is attached to support post 212 near heater assembly 202. In some embodiments, junction box 214 is attached near a base of support post 212. In some embodiments, junction box 214 is separate from support post 212. In some embodiments, junction box 214 comprises a battery. In some embodiments, the power supply connected to junction box 214 is an alternating current (AC) power source.

Controller 216 is configured to control junction box 214 to regulate the power provided to heater assembly 202. In some embodiments, controller 216 is configured to control junction box 214 to regulate power provided to antenna 204. Controller 216 helps to maintain the electronics of antenna 204 within the operating temperature range. In some embodiments, the lower limit of the operating temperature range ranges from −30° C. to −50° C. Controller 216 is configured to receive the measured temperature from the temperature sensor. In some embodiments, the temperature sensor is within one of mounting elements 210. In some embodiments, the temperature sensor is housed within antenna 204. In some embodiments, the temperature sensor is electrically connected to controller 216. In some embodiments, the temperature sensor is wirelessly connected to controller 216.

Based on the measured temperature received from the temperature sensor, controller 216 provides a signal to junction box 214 to either supply power to heater assembly 202 or not supply power to the heater assembly. In some embodiments, controller 216 is configured to provide analog control of the power supplied to heater assembly 202, i.e., a fraction of a maximum power is supplied to the heater assembly. In some embodiments, controller 216 is configured to provide digital control of the power supplied to heater assembly 202, i.e., power supply is either ON or OFF.

In some embodiments where heater assembly 202 includes a plurality of foil heaters 104, controller 216 is configured to control each foil heater independently of the other foil heaters. In some embodiments where heater assembly 202 includes a plurality of foil heaters 104, controller 216 is configured to control all foil heaters as a unit.

Figure 9:
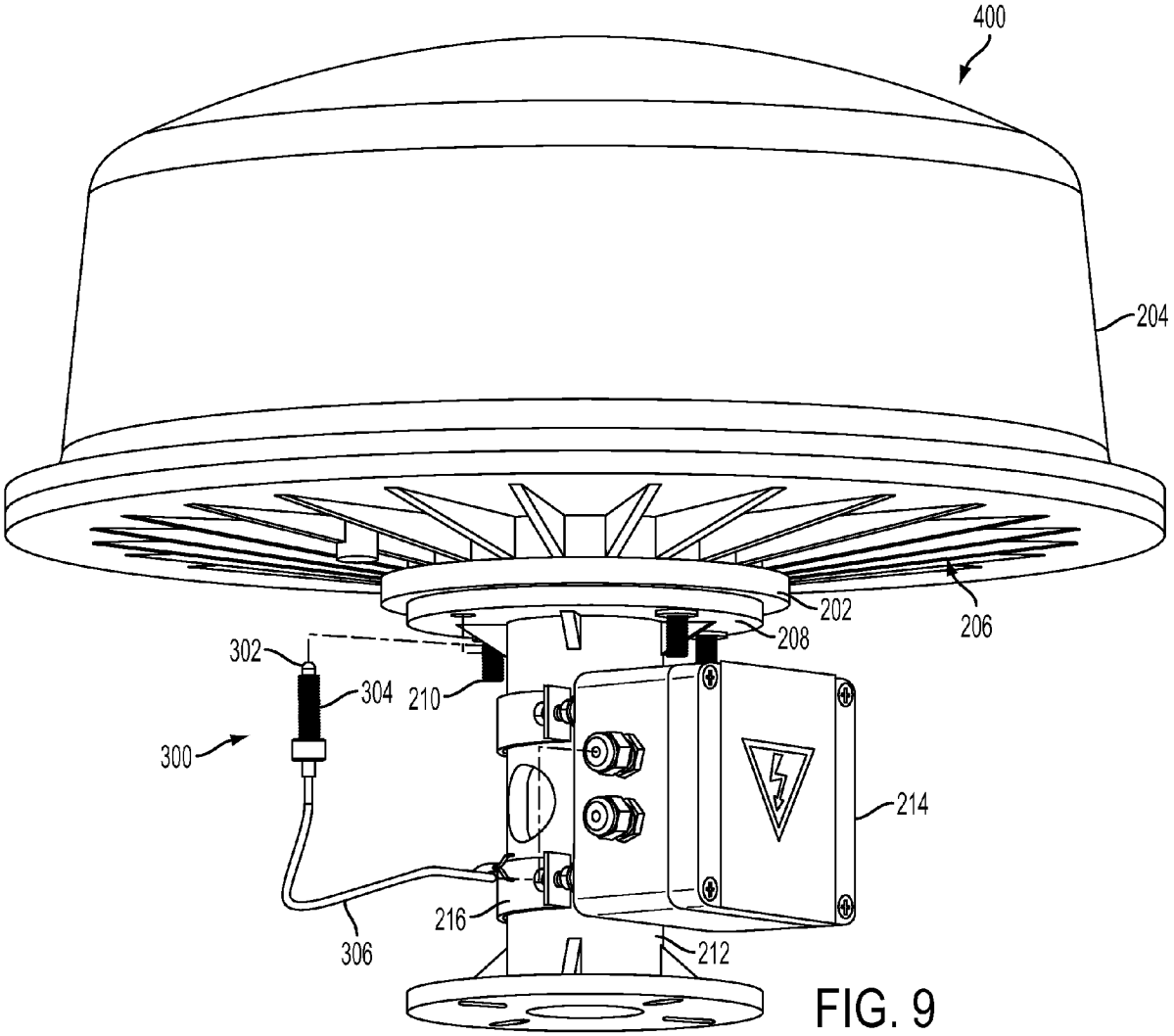
FIG. 9 is a perspective view of the antenna assembly having the temperature sensor of FIG. 8A, in accordance with one or more embodiments.

FIG. 9 is a perspective view of an antenna assembly 400 including temperature sensor 300. The elements of antenna assembly 400 are similar to the elements of antenna assembly 200. Sensing element 302 is disposed inside hollow mounting element 304. Connector 306 couples sensing element 302 to controller 216. Hollow mounting element 304 is configured to pass through mounting base 208 and heater assembly 202 to securely fasten antenna 204 to the mounting base. Sensing element 302 is configured to pass into the interior of antenna 204 to detect the temperature of the electronics within the antenna. The detected temperature is transmitted to controller 216 through connector 306.

One aspect of this description relates to a heater assembly including a foil heater having at least one slot. The heater assembly further includes an insulating plate configured to electrically and thermally insulate the foil heater, the insulating plate having a central opening, at least one first mounting hole and at least one first fastening hole. The heater assembly further includes a heat dissipation element configured to conduct heat from the foil heater to an exterior of the heater assembly, the heat dissipation element having at least one second mounting hole and at least one second fastening hole. The foil heater is between the insulating plate and the heat dissipation element. The at least one first mounting hole, the at least one slot and the at least one second mounting hole are aligned. The at least one first fastening hole, the at least one slot and the at least one second fastening hole are aligned.

Another aspect of this description relates to a heater assembly including a foil heater and an insulating plate configured to electrically and thermally insulate the foil heater. The insulating plate including a central opening, a base portion configured to support the foil heater, an inner surface defining the central opening and extending in a direction perpendicular to the base portion and an outer surface extending from an outer perimeter of the insulating plate and extending in the direction perpendicular to the base portion. The base portion, the inner surface and the outer surface enclose the foil heater on three sides. The heater assembly further includes a heat dissipation element configured to conduct heat from the foil heater to an exterior of the heater assembly. The foil heater is between the insulating plate and the heat dissipation element.

Still another aspect of this description relates to an antenna assembly including an antenna and a heater assembly. The heater assembly including a foil heater having at least one slot; an insulating plate configured to electrically and thermally insulate the foil heater, the insulating plate having a central opening, and at least one first mounting hole; and a heat dissipation element configured to conduct heat from the foil heater to an exterior of the heater assembly, the heat dissipation element having at least one second mounting hole. The antenna assembly further includes at least one mounting element configured to pass through the at least one first mounting hole, the at least one slot and the at least one second mounting hole to removably mount the heater assembly to the antenna.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A heater assembly comprising:

a foil heater having at least one slot;

an insulating plate configured to electrically and thermally insulate the foil heater, the insulating plate defining a central opening, at least one first mounting hole and at least one first fastening hole; and a heat dissipation element configured to conduct heat from the foil heater to an exterior of the heater assembly, the heat dissipation element having at least one second mounting hole and at least one second fastening hole, and wherein the foil heater is between the insulating plate and the heat dissipation element, the at least one first mounting hole, the at least one slot and the at least one second mounting hole are aligned.

2. The heater assembly of claim 1, further comprising wires electrically connected to the foil heater extending through the central opening.

3. The heater assembly of claim 1, wherein the foil heater comprises a plurality of heaters.

4. The heater assembly of claim 1, wherein the at least one fastening hole extends completely through the insulating plate.

5. The heater assembly of claim 1, wherein the at least one fastening hole is a threaded hole.

6. The heater assembly of claim 1, wherein the insulating plate comprises:

a base portion configured to support the foil heater;

an inner surface defining the central opening and extending in a direction perpendicular to the base portion; and an outer surface extending from an outer perimeter of the insulating plate and extending in the direction perpendicular to the base portion, wherein the base portion, the inner surface and the outer surface enclose the foil heater on three sides.

7. A heater assembly comprising:

a foil heater;

an insulating plate configured to electrically and thermally insulate the foil heater, the insulating plate comprising:

a base portion configured to support the foil heater;

an inner surface defining a central opening and extending in a direction perpendicular to the base portion; and an outer surface extending from an outer perimeter of the insulating plate and extending in the direction perpendicular to the base portion, wherein the base portion, the inner surface and the outer surface enclose the foil heater on three sides; and a heat dissipation element configured to conduct heat from the foil heater to an exterior of the heater assembly, wherein the foil heater is between the insulating plate and the heat dissipation element.

8. The heater assembly of claim 7, wherein the base portion, the inner surface and the outer surface enclose at least a portion of the heat dissipation element on three sides.

9. The heater assembly of claim 7, wherein a top surface of the heat dissipation element extends beyond a top edge of the inner surface in the direction perpendicular to the base portion.

10. The heater assembly of claim 7, wherein a top surface of the heat dissipation element is substantially level with a top edge of the inner surface and a top edge of the outer surface.

11. The heater assembly of claim 7, further comprising wires electrically connected to the foil heater extending through the central opening.

12. The heater assembly of claim 7, wherein the foil heater has at least one slot, the insulating plate has at least one first mounting hole and at least one first fastening hole, the heat dissipation element has at least one second mounting hole and at least one second fastening hole, the at least one first mounting hole, the at least one slot and the at least one second mounting hole are aligned, and the at least one first fastening hole, the at least one slot and the at least one second fastening hole are aligned.

13. An antenna assembly comprising:

an antenna;

a heater assembly, the heater assembly comprising:

a foil heater having at least one slot;

an insulating plate configured to electrically and thermally insulate the foil heater, the insulating plate defining a central opening, and at least one first mounting hole; and a heat dissipation element configured to conduct heat from the foil heater to an exterior of the heater assembly, the heat dissipation element having at least one second mounting hole; and at least one mounting element configured to pass through the at least one first mounting hole, the at least one slot and the at least one second mounting hole to removably mount the heater assembly to the antenna.

14. The antenna assembly of claim 13, further comprising:

a power supply configured to supply electrical power to the antenna and the heater assembly; and a controller configured to control the supply of electrical power to the heater assembly.

15. The antenna assembly of claim 14, further comprising a temperature sensor configured to measure a temperature inside the antenna.

16. The antenna assembly of claim 15, wherein the controller is configured to control the supply of electrical power to the heater assembly based on the temperature measured by the temperature sensor.

17. The antenna assembly of claim 15, wherein the temperature sensor is within the at least one mounting element.

18. The antenna assembly of claim 14, wherein the foil heater comprises a plurality of heaters and the controller is configured to control a power supply to each of the plurality of heaters independently of the other heaters of the plurality of heaters.

19. The antenna assembly of claim 13, further comprising a supporting post configured to support the antenna assembly in an elevated position, wherein the support post passes through the central opening.

20. The antenna assembly of claim 13, wherein the insulating plate comprises:

a base portion configured to support the foil heater;

an inner surface defining the central opening and extending in a direction perpendicular to the base portion; and an outer surface extending from an outer perimeter of the insulating plate and extending in the direction perpendicular to the base portion, wherein the base portion, the inner surface and the outer surface enclose the foil heater on three sides.

* * * * *